US009233476B2

(12) United States Patent
Clemons

(10) Patent No.: US 9,233,476 B2
(45) Date of Patent: Jan. 12, 2016

(54) THIN SAFETY RAZOR

(71) Applicant: Xavier Clemons, Ypsilanti, MI (US)

(72) Inventor: Xavier Clemons, Ypsilanti, MI (US)

( * ) Notice: Subject to any disclaimer, the term of this patent is extended or adjusted under 35 U.S.C. 154(b) by 273 days.

(21) Appl. No.: 13/854,166

(22) Filed: Apr. 1, 2013

(65) Prior Publication Data

US 2013/0276311 A1 Oct. 24, 2013

Related U.S. Application Data

(60) Provisional application No. 61/687,324, filed on Apr. 23, 2012.

(51) Int. Cl.

| | |
|---|---|
| ***B26B 21/06*** | (2006.01) |
| ***B26B 21/22*** | (2006.01) |
| ***B26B 21/52*** | (2006.01) |
| ***B26B 21/40*** | (2006.01) |

(52) U.S. Cl.

CPC ..... *B26B 21/4037* (2013.01); *B26B 21/06* (2013.01); *B26B 21/22* (2013.01); *B26B 21/52* (2013.01)

(58) Field of Classification Search

CPC .... B26B 21/06; B26B 21/4037; B26B 21/22; B26B 21/52

USPC ..... 30/539, 540; D28/48

See application file for complete search history.

(56) References Cited

U.S. PATENT DOCUMENTS

| | | | | | |
|---|---|---|---|---|---|
| 2,053,550 | A | * | 9/1936 | Chodaczok | 30/47 |
| 2,320,807 | A | * | 6/1943 | Upham | 30/540 |
| 2,799,927 | A | * | 7/1957 | Beham | 30/66 |
| 2,878,563 | A | * | 3/1959 | Schmoyer | 30/539 |
| 3,488,764 | A | * | 1/1970 | Welsh | 30/50 |
| 4,071,952 | A | * | 2/1978 | Meshulam et al. | 30/151 |
| 4,554,735 | A | * | 11/1985 | Chen | 30/47 |
| 4,831,729 | A | * | 5/1989 | Beuchat | 30/40.2 |
| D302,739 | S | * | 8/1989 | Beuchat | D28/48 |
| 4,996,772 | A | * | 3/1991 | Iten | 30/41 |
| 5,461,782 | A | * | 10/1995 | Rauch | 30/47 |
| 5,604,983 | A | * | 2/1997 | Simms et al. | 30/49 |
| 5,692,529 | A | * | 12/1997 | Fekete | 132/291 |
| 5,927,298 | A | * | 7/1999 | Tiram | 132/291 |
| D416,647 | S | * | 11/1999 | Wonderley | D28/48 |
| 6,434,828 | B1 | * | 8/2002 | Andrews | 30/50 |
| 6,505,403 | B1 | * | 1/2003 | Andrews | 30/29.5 |
| 6,598,303 | B2 | * | 7/2003 | Bosy et al. | 30/526 |
| 6,901,669 | B1 | * | 6/2005 | Liberatore | 30/540 |
| 7,028,405 | B2 | * | 4/2006 | Paas et al. | 30/45 |
| 7,814,661 | B2 | * | 10/2010 | Tomassetti | 30/41 |
| 2007/0251106 | A1 | * | 11/2007 | Gladstone | 30/526 |
| 2010/0064520 | A1 | * | 3/2010 | Park et al. | 30/29.5 |
| 2012/0223082 | A1 | * | 9/2012 | Fallas | 220/503 |

FOREIGN PATENT DOCUMENTS

DE 100 16 751 C2 * 10/2001

* cited by examiner

*Primary Examiner* — Hwei C Payer

(74) *Attorney, Agent, or Firm* — Thomas P. Heed

(57) ABSTRACT

A safety razor with a thin profile that can be easily transported on a person, without risk of injury or damage to the razor blades.

17 Claims, 8 Drawing Sheets

THIN SAFETY RAZOR

FIELD OF INVENTION

Generally, this invention relates to the class of inventions known as Cutlery. More specifically, this invention belongs to the sub-classes of razors with multiple blades.

BACKGROUND OF INVENTION

Most men shave some portion of their face every day, or nearly every day. For many men, their beard grows so fast and dense, that they shave more than once per day. Most men with fast-growing and/or thick beards prefer to wet-shave with a safety razor. Wet shaving is using a razor with water and a lubricant, such as shaving cream or soap. A safety razor is a device which has embedded razor blades, to reduce the risk of an inadvertent cut. A safety razor holds one or more razor blades at an angle that will properly shave a beard, while keeping the user's hands a safe distance from the cutting surface. A plurality of men use safety razors to shave.

Most wet-shave safety razors are impractical for a person to carry. Typical safety razors have a head and a handle, forming, roughly, a "T." Although many safety razors come with a blade protector, the blade protector is generally easy to knock off. Additionally, the shape of the safety razor makes it clumsy to carry in a pocket, purse, or back-pack. When a safety razor is carried in such a way it is easily damaged. Additionally, the blade cover is easily removed through natural jossling and movement, risking injury, or at the very least, a dull and useless blade. Because of these drawbacks, few people carry a safety razor with them during the day.

This creates a difficulty for men who travel and have a thick beard. By the end of the work-day, they would like to shave their beard a second time, but they do not have the means to do so.

Disposable safety razors have additional issues. Disposable safety razors have the same form-factor as a regular safety razor. As a result, they are difficult to vend, because they are relatively bulking and poorly shaped. Additionally, disposable safety razors are relatively expensive to ship, because they do not nest or pack well in a box. Not only does this increase the cost of shipping the disposable safety razor, because the box is full of air, it increases the cost of putting the safety razor on display on a store shelf. Last, disposable safety razors are environmentally unfriendly. They are made out of plastic that is placed in a landfill. Although the metal will bio-degrade, the plastic will not. Additionally, since the metal is embedded in the plastic, the plastic cannot be re-cycled.

The market is looking for a thin, disposable safety razor that can be easily carried by a person during the day. Preferably, such a device should be easy to carry in a safe place, such as a wallet or purse.

SUMMARY OF THE INVENTION

The present invention improves upon the current prior art, in several important aspects. The present invention is a safety shaver, designed to have a form factor similar to a traditional credit card in width and length. The present invention would be thicker than a traditional credit card, but would have, nonetheless, a very thin profile.

The present invention can have one or more razor blades. The blades are embedded in an integral body. The integral body is made out of hard plastic, including, but not limited to, polylactic acid (PLA) and ABS. In fact PLA would be an ideal material for a disposable safety razor, because the material both bio-degrades and is recyclable into new PLA (cradle-to-cradle recycling). Alternately, the integral body could be made out of other water-proof, hard materials, such as metal. The present invention comes with a firmly fitting cap, to protect the blades.

One embodiment of the invention would have a notch extending around the periphery of the blade head, near where the blades are located. After the blades become dull, such an embodiment would be more environmentally friendly. Using the cap, it would be easy to break the blade head off of the main part of the integral body. As a result, most of the invention, by weight would be recyclable as a single material.

DETAILED DESCRIPTION OF THE INVENTION

This description does not limit the invention, but rather illustrates its general principles of operation. Examples are illustrated with the accompanying drawings. A variety of drawings are offered, showing the present invention incorporated into two primary embodiments.

Figure 1:
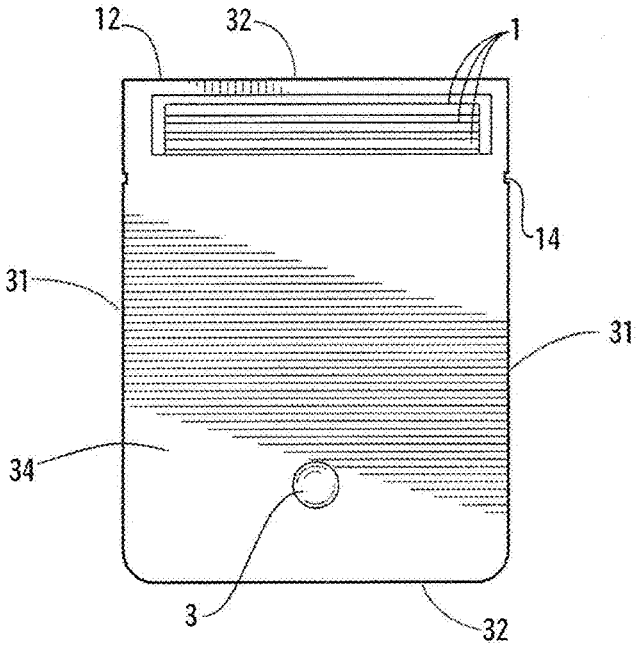
FIG. 1 shows a full front view of the first embodiment of the present invention.
Figure 2:
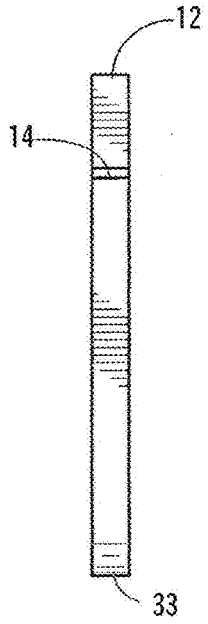
FIG. 2 is a full side view of the first embodiment of the present invention.
Figure 8:
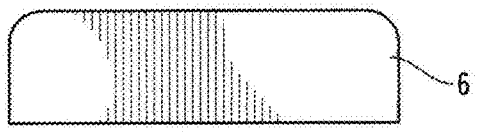
FIG. 8 is a full front view of the cap of the present invention.
Figure 9:
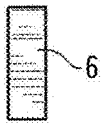
FIG. 9 is a side view of the cap of the present invention.

FIG. 1 shows a full front view of the first embodiment of the present invention. The present invention contains a plurality of razor blades 1 embedded in an integral body 12. The integral body 12 has a planar face 34 with two coplanar long edges 31 and two coplanar short edges 32. The razor blades 1 are embedded during fabrication using common molding technics, including, but not limited to, insert injection molding. The razor blades 1 are angled so as to make a suitable cutting angle for shaving a beard. The integral body 12 has a thumb-sized dimple 3, to help the user grip the present invention. The integral body 12 is most commonly produced from plastic, including, but not limited to ABS, Noryl, polycarbonate, and polypropylene. The integral body 12 contains a notch 14 that securely captures the cap of the present invention. FIG. 2 shows a full side view of the present invention, showing that the integral body 12 has a thin profile, defined by a width 33. FIG. 8 and FIG. 9 show a cap 6 that fits over the blades 1 of the present invention. In the first embodiment, the cap 6 fits proud over the blades 1, meaning the cap 6 sticks out from the integral body 12.

Figure 3:
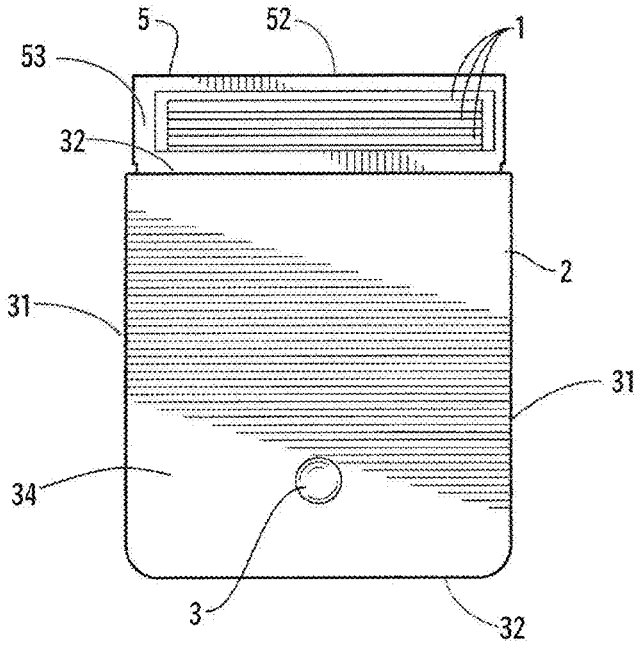
FIG. 3 shows a full front view of a second embodiment of the present invention.
Figure 4:
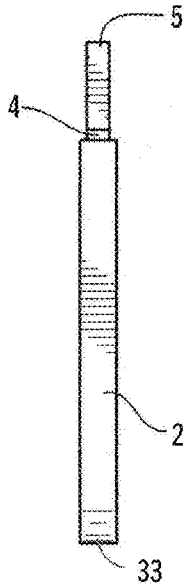
FIG. 4 is a full side view of a second embodiment of the present invention.
Figure 10:
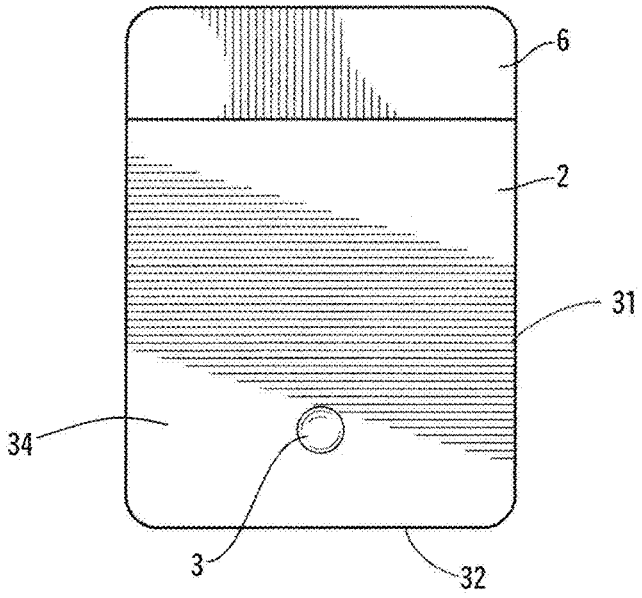
FIG. 10 is a full front view of the present invention with cap.

FIG. 3 shows a full front view of the second embodiment of the present invention. This embodiment still contains razor blades 1 that are embedded in an integral body 2, 5 using common molding technics. The integral body is molded so that it has two regions: a blade head 5 and a main body 2. These two regions 5, 2 are molded as a single body. The main body 2 has a planar face 34 with two coplanar long edges 31 and two coplanar short edges 32. The blade head 5 has a planar face 53, and a lateral edge 52. The short edges 32 of the main body 2 are parallel, but not coplanar, with the lateral edge 52 of the blade head 5. The planar face 34 of the main body 2 is parallel, but not coplanar, with the planar face 53 of the blade head 5. The razor blades 1 are angled so as to make a suitable cutting angle for shaving a beard. The main body 2 has a thumb-sized dimple 3, to help the user grip the present invention. The integral body 5, 2 is most commonly produced from plastic, including, but not limited to ABS, Noryl, polycarbonate, and polypropylene. The integral body 5, 2 contains a notch 4 that securely captures the cap of the present invention. FIG. 4 shows a full side view of the present invention, showing that the main body of the integral body 2 has a thin profile, defined by a width 33. In FIG. 10, the second embodiment has a cap 6 that fits flush, over the blades 1, with the main body 2.

Figure 5:
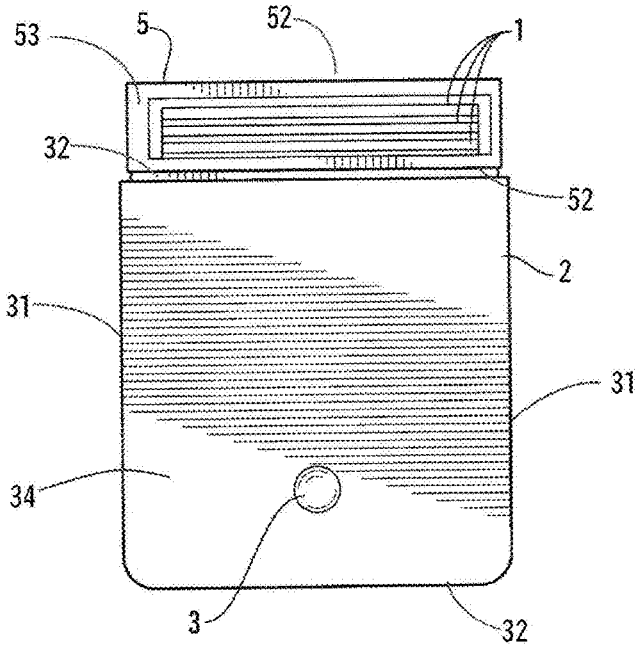
FIG. 5 is a full front view of a third embodiment of the present invention.
Figure 6:
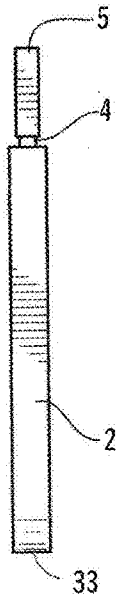
FIG. 6 is a full side view of a third embodiment of the present invention.
Figure 7:
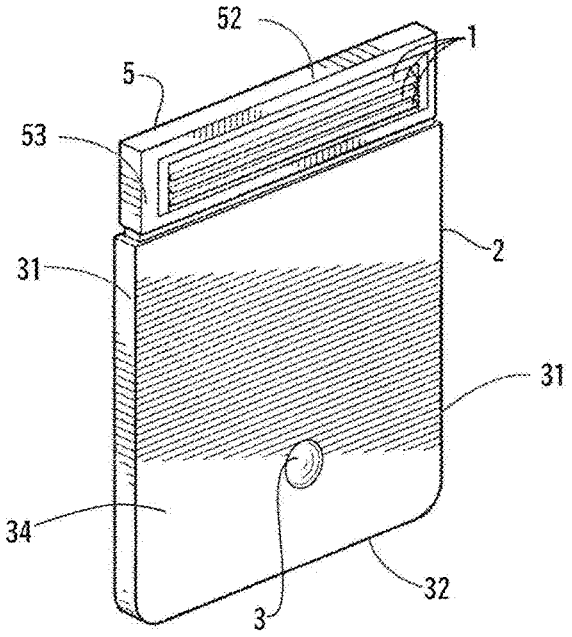
FIG. 7 is a perspective view of the present invention.
Figure 12:
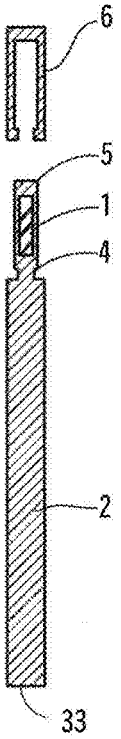
FIG. 12 is a side, see-through view of the present invention.

FIG. 5 shows a full front view of the third embodiment of the present invention. This embodiment still contains razor blades 1 that are embedded in an integral body 2, 5 using common molding technics. The integral body is molded so that it has two regions: a blade head 5 and a main body 2. These two regions 5, 2 are molded as a single body. The main body 2 has a planar face 34 with two coplanar long edges 31 and two coplanar short edges 32. The blade head 5 has a planar face 53 and two lateral edges 52. The short edges 32 of the main body 2 are parallel, but not coplanar, with the lateral edges 52 of the blade head 5. The planar face 34 of the main body 2 is parallel, but not coplanar, with the planar face 53 of the blade head 5. The razor blades 1 are angled so as to make a suitable cutting angle for shaving a beard. The main body 2 has a thumb-sized dimple 3, to help the user grip the present invention. The integral body 5, 2 is most commonly produced from plastic, including, but not limited to ABS, Noryl, polycarbonate, and polypropylene. The integral body 5, 2 contains a notch 4 that securely captures the cap of the present invention. In this embodiment, the notch 4 extends around the entire periphery of the blade head 5, defining a circumferential notch 4 and a second lateral edge 52 (compare FIG. 3 and FIG. 5). The extended notch 4 more securely captures the cap 6, and allows the blade head 5 to flex with respect to the main body 2. This can present the blades 1 at a better angle to shear a beard. Additionally, the extended notch 4 allows the user to break off the blade head 5, using the cap 6, once the blades 1 become dull and useless. FIG. 6 shows a full side view of the present, third embodiment of the invention, showing that the integral body 2 has a thin profile, defined by a width 33. In the FIG. 10, the third embodiment, like the second embodiment, has a cap 6 that fits flush, over the blades 1, with the main body 2. FIG. 7 shows a perspective view of the third embodiment, clearly showing the thumb-sized dimple 3, main body 2, blades 1, the blade head 5, the face 34, a short edge 32, two long edges 31, and a lateral edge 52. FIG. 12 is a see-through side-view of the third embodiment, showing the blades 1, the main body 2, the blade head 5, the notch 4, the width 33, and the cap 6. This view shows the spacing and angling of the blades 1, so that they may most effectively cut the beard.

Figure 11:
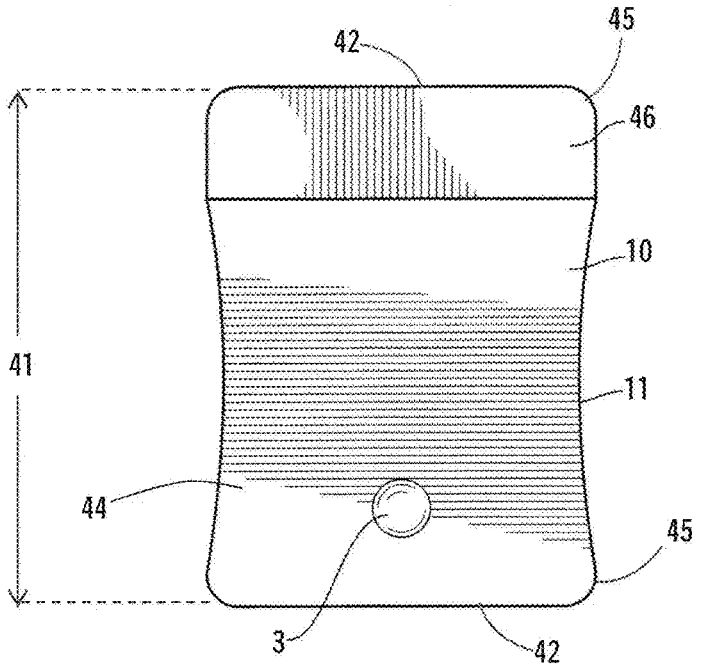
FIG. 11 is a full front view of a fourth embodiment of the present invention, with cap.

A fourth embodiment is shown in FIG. 11, with the cap 46 on. The major change in this embodiment is that the integral body 10 has two contoured sides 11. The fourth embodiment has curved corners 45, a face 44, a shorter edge 42, a longer cap edge 142, and a longer dimension 41. The longer dimension 41 is the linear distance between the shorter edge 42 of the integral body 10 and the longer cap edge 142 of the cap 46. The shorter edge 42 of the integral body 10 and the longer cap edge 142 of the cap 46 are co-planar.

I claim:

1. A thin, flat safety shaver comprised of at least one razor blade, angled and presented to a user in a way that allows beard hair to be efficiently cut, and embedded in an integral body; a snugly fitting cap, for protecting the at least one razor blade, which securely engages with a notch placed in the integral body to retain the cap; said integral body having a front, planar face, on which the at least one razor blade is exposed for shaving; said face is roughly rectangular with rounded corners; said integral body having a width, said width being the smallest dimension of the integral body, and said face being a substantially planar surface being defined by two equal length, co-planar longer edges and two co-planar shorter edges; and said integral body having an aspect ratio of the width to either of the longer edges of no more than 1:10.

2. The thin, flat safety shaver in claim 1, wherein the integral body is made from polylactic acid (PLA).

3. The thin, flat safety shaver in claim 1, wherein the integral body is made from ABS.

4. The thin, flat safety shaver in claim 1, wherein there are three or more razor blades.

5. The thin, flat safety shaver in claim 1, wherein the integral body has a substantially uniform cross-section, except for the embedded razor blade.

6. The thin, flat safety shaver in claim 1, wherein the cap, when engaged, protrudes beyond the integral body.

7. A thin, flat safety shaver comprised of at least one razor blade, angled and presented to a user in a way that allows beard hair to be efficiently cut, and embedded in an integral body, wherein said integral body has two pronounced cross-sections, a first said cross-section defining a blade head area, and a second said cross-section defining a main body area; a snugly fitting cap, for protecting the at least one razor blade, which securely engages with a notch placed in the integral body, between said blade head area and said main body area, to retain the cap; said blade head area of said integral body having a front, planar face, on which the at least one razor blade is exposed for shaving, wherein the front, planar face of the blade head area is roughly rectangular; said main body area having a front, planar face wherein the front, planar face of the main body area has two equal length, co-planar longer edges, two co-planar shorter edges, and a width; said width being the smallest dimension of the integral body in the main body area; said thin, flat safety shaver having an aspect ratio of the width to either of the longer edges of no more than 1:10; and wherein the front, planar face of the main body area is parallel, but not coplanar, with the front, planar face of the blade head area.

8. The thin, flat safety shaver in claim 7, wherein the cap, when engaged, is flush with the integral body.

9. The thin, flat safety shaver in claim 7, wherein said notch extends around the periphery of the integral body, defining a transition region between said blade head area and said main body area.

10. The thin, flat safety shaver in claim 9, wherein the cap, when engaged, is flush with the integral body.

11. A thin, flat safety shaver comprised of at least one razor blade, angled and presented to a user in a way that allows beard hair to be efficiently cut, and embedded in an integral body; a snugly fitting cap with a longer cap edge, for protecting the at least one razor blade, which securely engages with a notch placed in the integral body to retain the cap; said integral body having a front, planar face, on which the at least one razor blade is exposed for shaving; said face having rounded corners, a shorter edge, and two contoured sides; wherein the longer cap edge of the snugly fitting cap and the shorter edge of the face are parallel and coplanar, and wherein a linear distance between the longer cap edge of the snugly fitting cap and the shorter edge of the face is defined as a longer dimension; said integral body having a width, said width being the smallest dimension of the integral body; and said integral body having an aspect ratio of the width to the longer dimension of no more than 1:10.

12. The thin, flat safety shaver in claim 11, wherein the integral body is made from polylactic acid (PLA).

13. The thin, flat safety shaver in claim 11, wherein the integral body is made from ABS.

14. The thin, flat safety shaver in claim 11, wherein there are three or more razor blades.

15. The thin, flat safety shaver in claim 11, wherein the integral body has a substantially cross-section, except for the embedded razor blade.

16. The thin, flat safety shaver in claim 15, wherein the cap, when engaged, protrudes beyond the integral body.

17. The thin, flat safety shaver in claim 11, wherein the cap, when engaged, is flush with the integral body.

* * * * *